US006625884B1

(12) United States Patent
Fukase et al.

(10) Patent No.: US 6,625,884 B1
(45) Date of Patent: Sep. 30, 2003

(54) METHOD OF DETERMINING A CONNECTION STATE OF METAL TERMINAL AND A WIRE

(75) Inventors: Yoshihiro Fukase, Shizuoka (JP); Toshihiro Maki, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 211 days.

(21) Appl. No.: 09/630,145

(22) Filed: Jul. 31, 2000

Related U.S. Application Data

(62) Division of application No. 09/148,188, filed on Sep. 4, 1998, now Pat. No. 6,113,441.

(30) Foreign Application Priority Data

Apr. 9, 1997 (JP) ..... 9-239567

(51) Int. Cl.[7] ..... H01R 43/04

(52) U.S. Cl. ..... 29/863; 29/857; 29/861; 29/867; 29/334; 29/747; 29/751; 29/753; 72/16.8

(58) Field of Search ..... 29/854, 861, 863, 29/865, 866, 867, 33 F, 33 M, 745, 747, 748, 749, 750, 751, 753, 761; 72/416, 16.2, 16.8, 17.3

(56) References Cited

U.S. PATENT DOCUMENTS

| | | | | |
|---|---|---|---|---|
| 5,271,254 A | * 12/1993 | Gloe et al. | ..... | 72/13.2 |
| 5,487,686 A | 1/1996 | Sawada | ..... | 439/884 |
| 5,533,914 A | 7/1996 | Sawada | ..... | 439/843 |

FOREIGN PATENT DOCUMENTS

| | | | |
|---|---|---|---|
| DE | 4005399 C1 | 4/1991 | |
| DE | 42 15 163 A1 | 11/1993 | |
| DE | 4408499 A1 | 9/1995 | |
| EP | 0 610 891 A2 | 8/1994 | |
| JP | 9-161938 | 6/1997 | ..... H01R/43/048 |

* cited by examiner

*Primary Examiner*—Richard Chang
(74) *Attorney, Agent, or Firm*—Sughrue Mion, PLLC

(57) ABSTRACT

A method of determining whether a metal terminal including a conductor clamping section for clamping a wire is satisfactorily connected to the wire. First, a first metal terminal including a first conductor clamping section for clamping a first wire thereto is provided. Next, one of a dimensional variation and a ratio of a dimensional change of the first conductor clamping section in an axial direction of the first metal terminal, which are caused by clamping the first conductor clamping section, is calculated. Compressibility comparison data is prepared by calculating, from a section of the first conductor clamping section after clamping the first conductor clamping section, compressibility of the first wire with respect to the first conductor clamping section based on the one of the dimensional variation and the ratio of the dimensional change. After preparing the compressibility comparison data, a second metal terminal including a second conductor clamping section for clamping a second wire is provided, and one of a dimensional variation and a ratio of a dimensional change in distance between marks applied along formation reference positions on the second conductor clamping section is calculated and is compared with the compressibility comparison data, thereby determining whether the second metal terminal is satisfactorily connected to the second wire.

6 Claims, 5 Drawing Sheets

METHOD OF DETERMINING A CONNECTION STATE OF METAL TERMINAL AND A WIRE

This is a divisional of application Ser. No. 09/148,188 filed Sep. 4, 1998, now U.S. Pat. No. 6,113,441, the disclosure of which is incorporated herein by reference.

BACKGROUND OF THE INVENTION

1. Field of the Invention

This invention relates to a method of determining whether or not a conductor clamping section of a metal terminal is satisfactorily connected to a wire, and also relates to the metal terminal.

The present application is based on Japanese Patent Application No. Hei. 9-239567, which is incorporated herein by reference.

2. Description of the Related Art

A metal terminal includes an electrical contact section having a predetermined configuration, and a wire connecting section having a conductor clamping section which is connected to a wire by pressure contact. Before conducting the pressure contact, the wire is cut to a predetermined length, and then an insulating sheath at an end portion of the wire is removed.

When the metal terminal is connected to a conductor of the wire by pressure contact, the metal terminal must be completely electrically connected to the wire, and must have a holding force which is equivalent to the tensile strength of the wire. That is, the pressure contact of the metal terminal to the wire must be high both electrically and mechanically.

If the pressure contact is not sufficient, a gap may be formed between the conductor clamping section of the metal terminal and the conductor of the wire. In this case, since the holding force by the conductor clamping section is small, the conductor of the wire may easily come off the metal terminal.

A quality control test may be performed at the production site by cutting a conductor clamping section, which is clamping a conductor of a wire, of a metal terminal across the axis of the terminal. From the resultant section, the compressibility of the wire with respect to the conductor clamping section is calculated. Using the compressibility as one yardstick, the connection state between the metal terminal and the wire is determined.

On the other hand, when the metal terminal is connected to the wire by pressure contact, wire breakage preventing bellmouths are formed on both end portions of the conductor clamping section in an axial direction of the terminal so as to hem the end portions. Similar to the above-described quality control test, the width of the bellmouths in the axial direction of the terminal may be periodically measured in order to determine the formation state of the conductor clamping section.

In the above-described structure, it is troublesome to determine the connection state. That is, whenever the connection state between the metal terminal and the wire is to be determined, the conductor clamping section must be cut to examine the compressibility of the wire with respect to the conductor clamping section. Since the aforementioned operation takes a long time, manufacturing productivity is lowered.

Further, measurement of the dimensions of the bellmouths is troublesome because the bellmouths are extremely small. Therefore, such a measurement is liable to result in an error.

Further, manufacturing productivity is lowered, and the connection of the wire is not sufficiently reliable.

SUMMARY OF THE INVENTION

In order to eliminate the above-described problems, it is an object of the present invention to provide a method of determining whether a metal terminal is satisfactorily connected to a wire, whether the wire is satisfactorily connected to a conductor clamping section of the metal terminal, and whether formation of wire breakage preventing bellmouths is acceptable, such that productivity and reliability of quality control may be markedly improved.

To achieve the above object, according to the first aspect of the present invention, there is provided a method of determining whether a metal terminal including a conductor clamping section for clamping a wire thereto is satisfactorily connected to the wire. First, a first metal terminal including a first conductor clamping section for clamping a first wire thereto is provided. Next, one of a dimensional variation and a ratio of a dimensional change of the first conductor clamping section in an axial direction of the first metal terminal, which are caused by clamping the first conductor clamping section, is calculated. Compressibility comparison data is then prepared by calculating, from a section of the first conductor clamping section after clamping the first conductor clamping section, compressibility of the first wire with respect to the first conductor clamping section based on the one of the dimensional variation and the ratio of the dimensional change. A second metal terminal including a second conductor clamping section for clamping a second wire is provided, it is determined whether the second metal terminal is satisfactorily connected to the second wire by comparing one of a dimensional variation and a ratio of a dimensional change of the second conductor clamping section with the compressibility comparison data. According to the first aspect of the present invention, after preparing the compressibility comparison data, for example, a dimensional variation or a ratio of a dimensional change of a conductor clamping section can easily be periodically calculated and compared with the compressibility comparison data. Accordingly, whether the conductor clamping section is satisfactorily connected to the wire or not can be readily determined. In addition, productivity and the reliability of quality control are markedly improved.

Further, according to the second aspect of the present invention, the method of the first aspect of the present invention further comprises a step of applying a connection state determining belt-shaped mark to each of the first conductor clamping section and the second conductor clamping section before clamping. In the calculating step, the one of the dimensional variation and the ratio of the dimensional change of the first conductor clamping section is calculated based on a change in width of the mark caused by clamping the first conductor clamping section. In the determining step, the one of the dimensional variation and the ratio of the dimensional change of the second conductor clamping section is compared with the compressibility comparison data. Therefore, if the width of the mark is constant, measurement of dimension about the calculation of the dimensional variation or the ratio of the dimensional change is simplified. That is, whether the conductor clamping section is satisfactorily connected to the wire or not can be more readily determined. Accordingly, productivity and quality control are markedly improved.

Further, according to the third aspect of the present invention, the method of the first aspect of the present invention further comprises a step of applying a pair of connection state determining belt-shaped marks to each of the first conductor clamping section and the second conductor clamping section before clamping, such that the belt-shaped marks are confronted with each other. In the calculating step, the one of the dimensional variation and the ratio of the dimensional change of the first conductor clamping section is calculated based on a change in distance between the marks caused by clamping the first conductor clamping section. In the determining step, the one of the dimensional variation and the ratio of the dimensional change of the second conductor clamping section is compared with the compressibility comparison data. Therefore, if the distance between the pair of the belt-shaped marks is constant, measurement of dimension about the calculation of the dimensional variation or the ratio of the dimensional change is simplified. That is, whether the conductor clamping section is satisfactorily connected to the wire or not can be more readily determined. Accordingly, productivity and quality control are markedly improved.

Further, according to the fourth aspect of the present invention, in the method of the third aspect of the present invention, the marks are respectively applied along formation reference positions of wire breakage preventing bellmouths. The bellmouths are formed on both end portions of each of the first conductor clamping section and the second conductor clamping section by clamping each of the first conductor clamping section and the second conductor clamping section. The method further comprises a step of determining whether the formation of the bellmouths is acceptable or not by comparing the respective marks with respective positions of the bellmouths. In addition to the effects of the third aspect of the present invention, the fourth aspect of the present invention provides an effect in that whether or not the formation of the bellmouth is acceptable can be determined.

Furthermore, according to the fifth aspect of the present invention, there is provided a terminal which comprises an electrically conductive plate including a conductor clamping section to which a wire is connectable, and at least one belt-shaped mark applied to the conductor clamping section. In the terminal, the belt-shaped mark is for determining whether the wire is satisfactorily connected to the terminal or not, after one of dimensional variation and a ratio of a dimensional change, caused by clamping the conductor clamping section, is calculated. Accordingly, if the dimensional variation or the ratio of the dimensional change in an axial direction of the terminal is calculated, and the compressibility comparison data is prepared, then whether or not the conductor clamping section is satisfactorily connected to the wire can be readily determined by comparing the dimensional variation or the ratio of the dimensional change of the mark with the compressibility comparison data. Accordingly, productivity and the reliability of quality control are markedly improved.

Further, according to the sixth aspect of the present invention, in the terminal of the fifth aspect of the present invention, a plurality of the belt-shaped marks are applied along formation reference positions of wire breakage preventing bellmouths which are formed on both end portions of the conductor clamping section after the conductor clamping section is clamped. Accordingly, whether the conductor clamping section is satisfactorily connected to the wire or not and whether the formation of the wire breakage preventing bellmouth is acceptable or not can be determined.

Further, according to the seventh aspect of the present invention, in the terminal of the sixth aspect of the present invention, the width of each of the marks is equal to a range of dimensional tolerance of each of the respective bellmouths. Accordingly, the formation of the bellmouth can be visually determined based on the position of the end of the bellmouth with respect to the mark after clamping the conductor clamping section.

BRIEF DESCRIPTION OF THE DRAWINGS

FIG. 4).

DETAILED DESCRIPTION OF THE PREFERRED EMBODIMENTS

A preferred embodiment of the present invention will now be described with reference to FIGS. 1 to 8.

Figure 1:
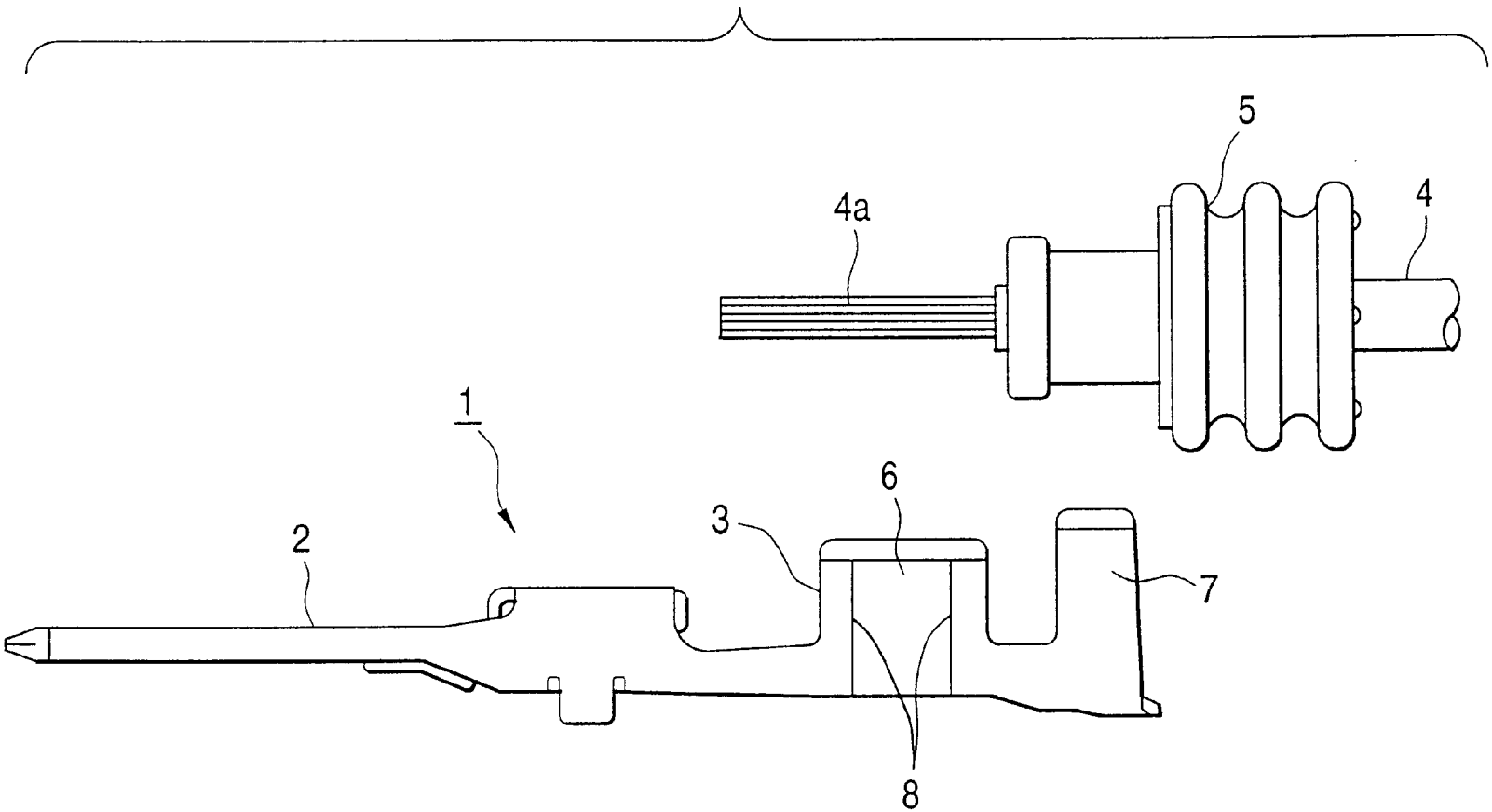
FIG. 1 is a diagram showing a method of determining a connection state of a metal terminal and a wire, and a metal terminal.

In FIG. 1, reference numeral 1 designates a metal terminal. The metal terminal 1 has a male type electrical contact section 2, and a wire connecting section 3. The metal terminal 1 is formed by pressing an electrically conductive plate such as a copper plate or a copper alloy plate (e.g., a brass plate or a beryllium-copper alloy plate). Reference numeral 4 denotes a wire. The insulating sheath is removed from the end portion of the wire 4 to expose a conductor 4*a*. After removing the insulating sheath, a rubber plug 5 is mounted on the wire 4.

The electrical contact section 2 is so designed that the electrically conductive plate is folded over to obtain a predetermined mechanical strength and a desired thickness. The wire connecting section 3 has a pair of conductor clamping sections 6, and a pair of insulating sheath clamping sections 7.

Figure 2:
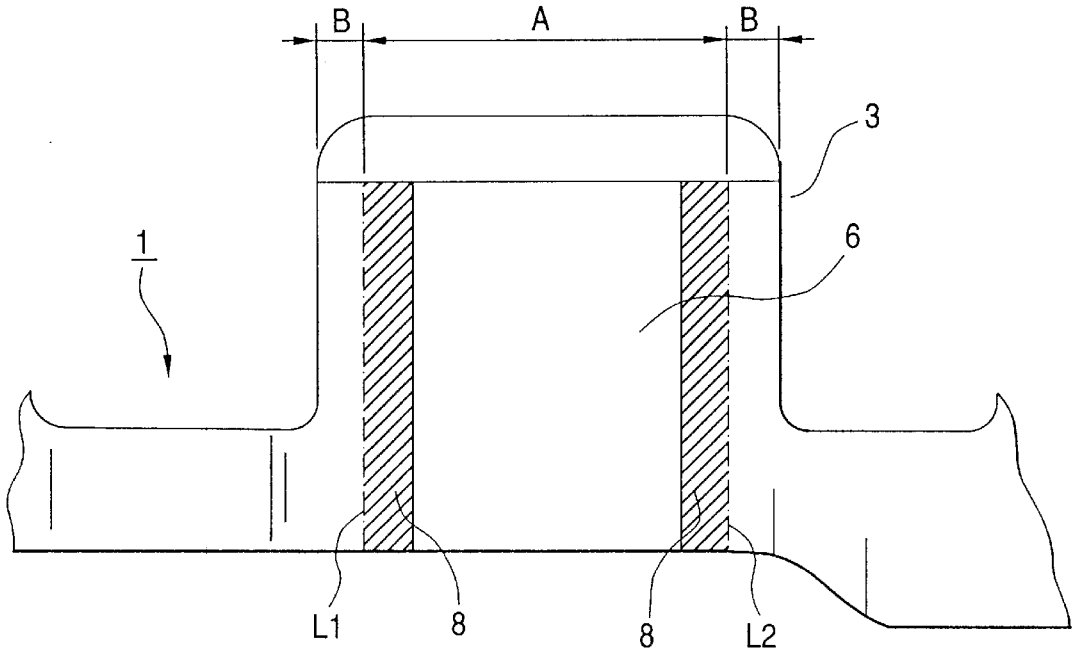
FIG. 2 is an enlarged diagram showing a conductor clamping section of the metal terminal shown in FIG. 1.

In FIG. 2, the conductor clamping section 6 is divided into a plurality of regions. A region between phantom lines L1 and L2 is a clamping region A which is clamped with a pressing member 11 shown in FIG. 3. Regions located outside the clamping region A are bellmouth forming regions B and B for bellmouths 9 and 9 (see FIG. 4) which prevent breakage of the conductor 4*a*.

A pair of connecting state determining belt-shaped marks 8 and 8 are applied to the clamping region A with paint or the like inside the phantom lines L1 and L2 as reference lines. The widths of the marks 8 and 8 are equal to respective ranges of dimensional tolerance of the respective bellmouths 9 and 9.

Figure 3:
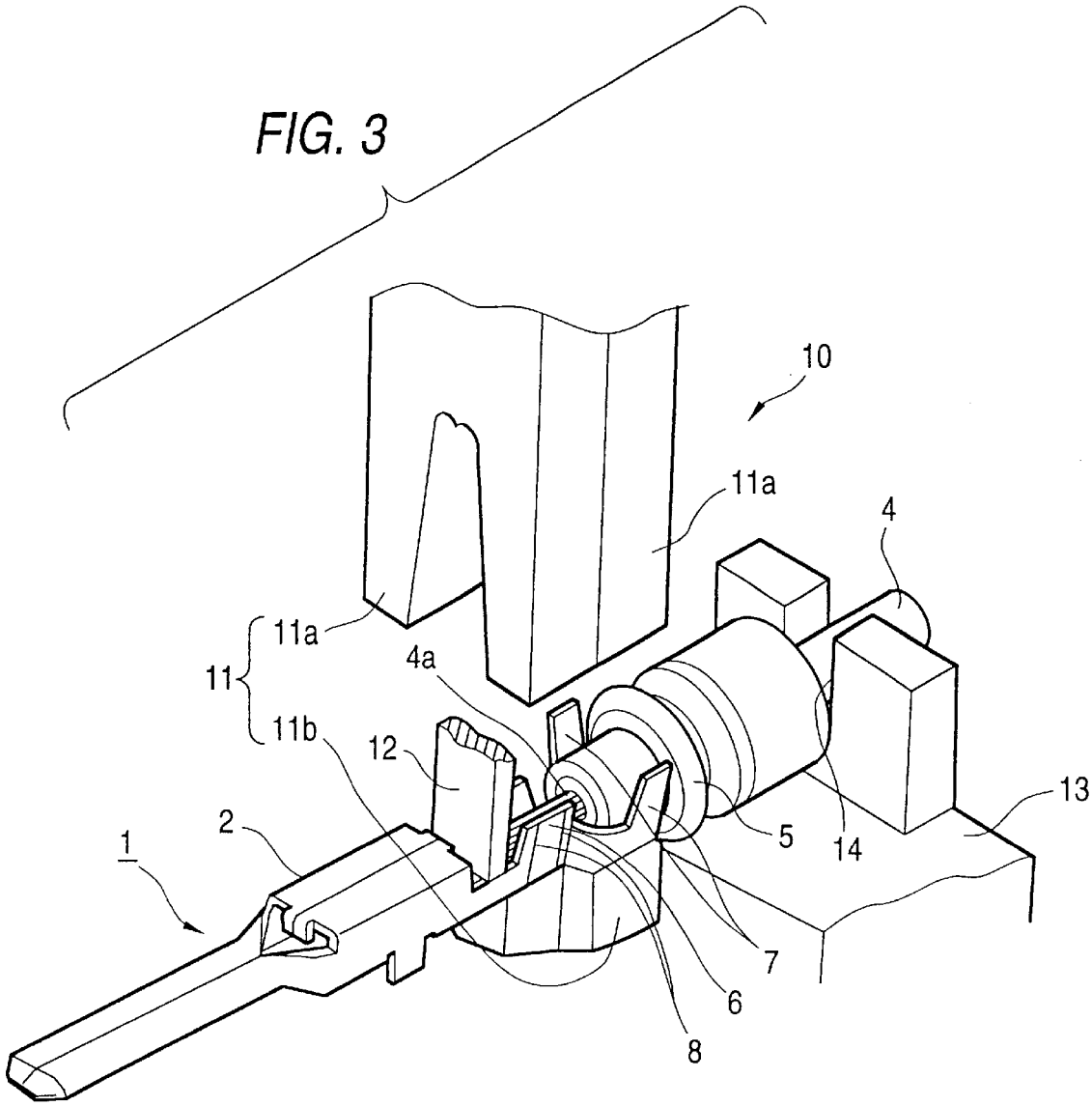
FIG. 3 is a perspective view for describing a process of connecting the metal terminal to the wire by pressure contact.

A process of connecting the metal terminal 1 to the wire 4 by pressure contact will now be described with reference to FIG. 3. In FIG. 3, reference numeral 10 designates a terminal pressing device; 11, a pressing member comprising a clamping mold 11*a* and a receiving section 11*b*; 12, a wire/terminal positioning member; and 13, a rubber plug positioning member having a positioning groove 14.

The metal terminal 1 is set in the receiving section 11*b*, and the wire/terminal positioning member 12 is moved downwardly toward the metal terminal 1. Then, the wire 4 is mounted on the metal terminal so that the conductor 4*a* abuts against the wire/terminal positioning member 12. Further, the rubber plug 5 is positioned with the rubber plug positioning member 13, and the rear end portion of the wire 4 is fitted in the positioning groove 14. Under this condition, the clamping mold 11*a* of the pressing member 11 is downwardly moved so that the conductor clamping section 6 and the insulating sheath clamping section 7 are plastically deformed, whereby the metal terminal 1 is fixedly connected to the wire 4.

Figure 4:
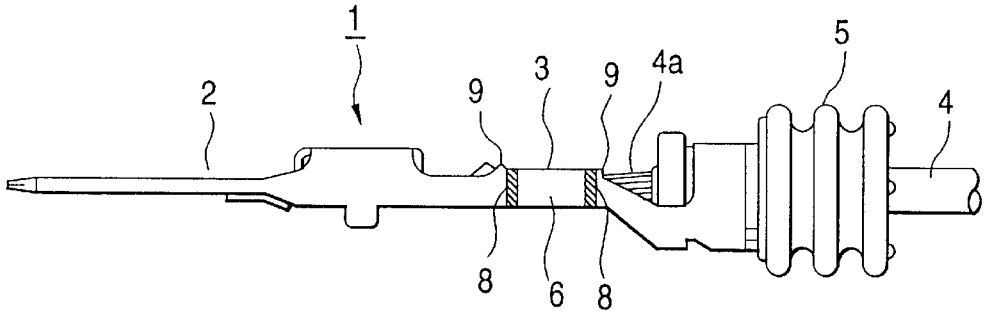
FIG. 4 is a front view of the metal terminal which is connected to the wire together with a rubber plug according to the process shown in FIG. 3.

Accordingly, as shown in FIG. 4, the wire 4 together with the rubber plug 5 is connected to the metal terminal 1. The clamping mold 11*a* (see FIG. 3) presses the clamping region A (see FIG. 2) of the conductor clamping section 6. After clamping, the bellmouths 9 and 9 are formed on both of the end portions of the conductor clamping section 6 in the axial direction of the terminal 1, with the phantom lines L1 and L2 as formation reference positions. The bellmouths 9 and 9 should hem both of the end portions of the conductor clamping section 6 in accordance with the bellmouth forming regions B and B (cf. FIG. 2) so as to prevent the conductor 4*a* from being cut by both edges of the conductor clamping section 6 during the clamping operation.

Figure 5:
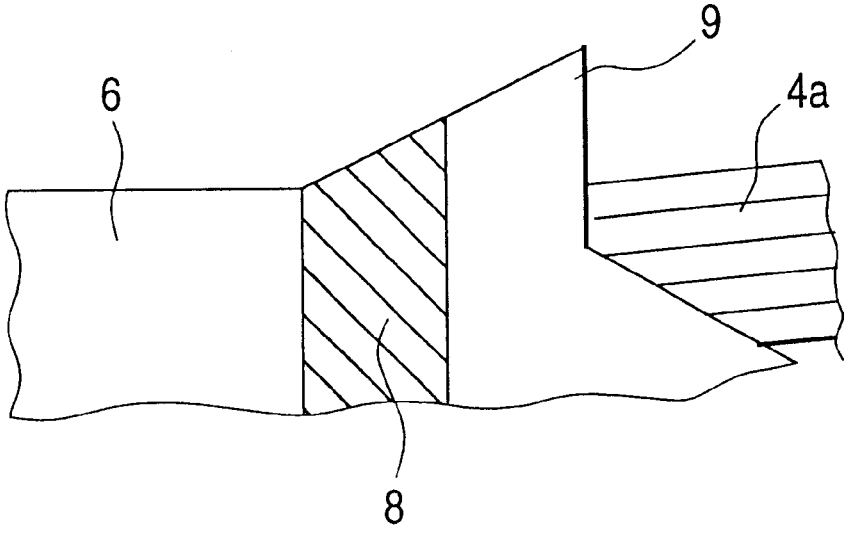
FIG. 5 is an enlarged diagram showing a bellmouth which is formed on a conductor clamping section at the upper limit of the dimensional tolerance.
Figure 6:
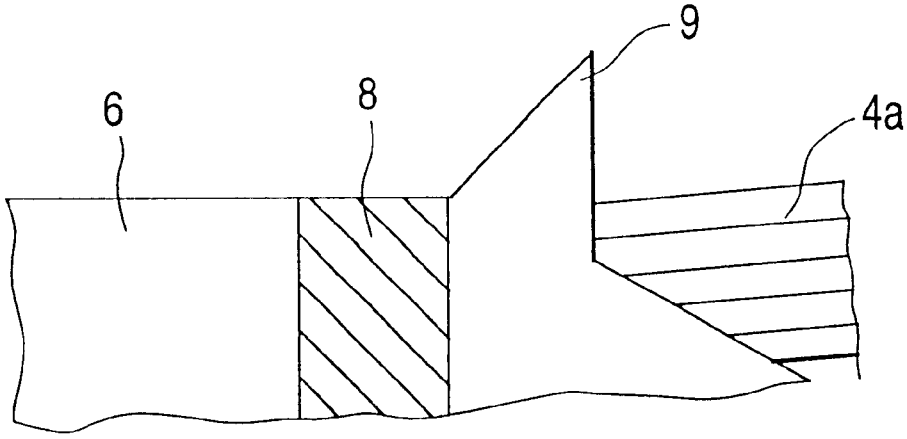
FIG. 6 is an enlarged diagram showing a bellmouth which is formed on the conductor clamping section at the lower limit of the dimensional tolerance.

A method of determining whether the formation of the bellmouths is acceptable or not, will now be described with reference to FIGS. 5 and 6.

When base end portions of the bellmouths 9 are shifted more towards the middle of the conductor clamping section 6 than the formation reference positions (i.e., the phantom lines L1 and L2), the marks 8 respectively come onto the base end portions of the bellmouths 9 because the marks 8 have widths corresponding to range of the dimensional tolerance of the bellmouths 9. When the bellmouths 9 are formed at the upper limit of the dimensional tolerance thereof, all of the marks 8 come onto the bellmouths 9 as shown in FIG. 5. Accordingly, the state of the bellmouths 9 can be detected such that the bellmouths 9 are formed at the upper limit of the dimensional tolerance thereof. On the other hand, when the bellmouths 9 are formed at the lower limit of the dimensional tolerance thereof as shown in FIG. 6, the base end portions of the bellmouths 9 respectively coincide with the end portions of the marks 8 (i.e., the aforementioned formation reference positions). Accordingly, the state of the bellmouths 9 can be visually determined from the positions of the base end portions of the bellmouths 9.

Next, a method of determining whether or not the metal terminal 1 is satisfactorily connected to the wire 4, will be described.

Figure 7:
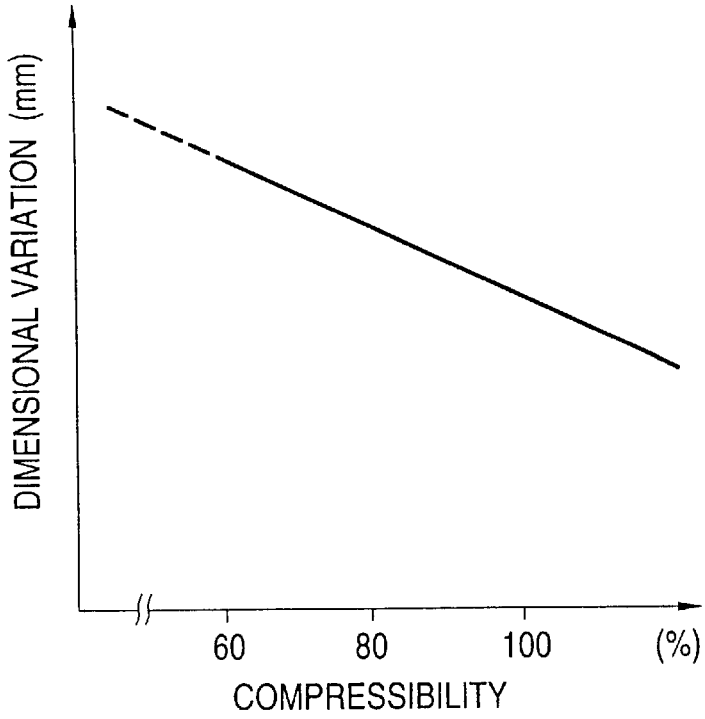
FIG. 7 is a graphical representation indicating compressibility versus conductor clamping section dimensional variation.

When the conductor clamping section 6 is clamped, it further extends in an axial direction of the terminal. More specifically, variation of the dimension (i.e., length) of the conductor clamping section 6 is caused while clamping the conductor clamping section 6. The connection-determination method utilizes this extension. First, a plurality of patterns of the variation of the dimension of the conductor clamping section 6 are sampled as a dimensional variation or a ratio of a dimensional change. For every pattern, the clamped conductor clamping section 6 is cut in a direction perpendicular to the axis of the terminal, and the section is utilized to obtain the compressibility of the wire 4 with respect to the conductor clamping section 6. Based on the foregoing, compressibility comparison data as shown in FIG. 7 is prepared. That is, a graph of compressibility versus dimensional variation is formed.

Thereafter, periodically or when necessary, a distance between marks 8 and 8 may be measured with a conventional measuring apparatus such as a sensor. That is, from a next metal terminal 1, based on a dimensional variation or a ratio of a dimensional change of a conductor clamping section 6 of the metal terminal 1, compressibility of a wire 4 with respect to the conductor clamping section 6 is determined from the graph of FIG. 7. In this case, whether the connection state between the metal terminal 1 and the wire 4 is satisfactory or not can be readily determined. Accordingly, this method can eliminate the problem accompanying the aforementioned related art.

Figure 8:
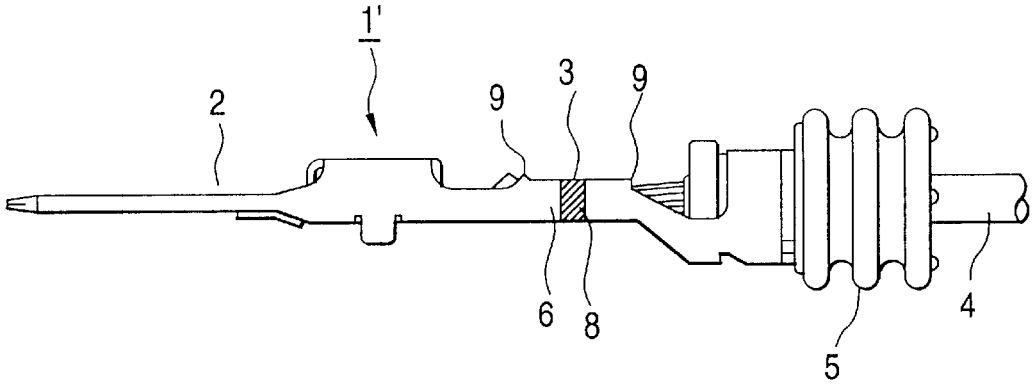
FIG. 8 is a front diagram showing another example of the position of the connecting state determining belt-shaped mark (cf.

Objects of the above-described embodiment include easily achieving the determination of whether the configuration of the bellmouths 9 are acceptable, and whether the metal terminal 1 is satisfactorily connected to the wire 4. Additionally, in the embodiment, the pair of connecting state determining belt-shaped marks 8 and 8 are applied to the conductor clamping section 6 as an example. However, if the object were only to determine whether or not the connection state between the metal terminal 1 and the wire 4 is satisfactory, then only one mark might be applied to the metal terminal 1. FIG. 8 shows such modification. As shown in FIG. 8, a mark 8' having a predetermined width is applied on the middle of the conductor clamping section 6 of a metal terminal 1'. In this case, after clamping the conductor clamping section 6, the width of the mark 8' is measured, and is compared with the aforementioned compressibility comparison data. Accordingly, whether the metal terminal 1' is satisfactorily connected to the wire 4 or not can be readily determined.

Although the metal terminal 1 or 1' having the male type electrical contact section 2 has been described, the electrical contact section is not limited to the male type. That is, the technical concept of the present invention is applicable to metal terminals of a variety of types. A feature of the present invention resides in the conductor clamping section which is clamped to connect a metal terminal to a wire. Hence, the technical concept of the present invention is applicable to other structures having a conductor clamping section.

What is claimed is:

1. A method of determining whether a metal terminal including a conductor clamping section for clamping a wire is satisfactorily connected to the wire, the method comprising steps of:

providing a first metal terminal including a first conductor clamping section for clamping a first wire;

determining in a first determining step one of a dimensional variation and a ratio of a dimensional change of the first conductor clamping section in an axial direction of the first metal terminal caused by clamping the first conductor clamping section;

preparing compressibility comparison data by calculating, from a section of the first conductor clamping section after clamping the first conductor clamping section, compressibility of the first wire with respect to the first conductor clamping section based on the one of the dimensional variation and the ratio of the dimensional change;

providing a second metal terminal including a second conductor clamping section for clamping a second wire; and determining in a second determining step whether in the second metal terminal is satisfactorily connected to the second wire by comparing one of a dimensional variation and a ratio of a dimensional change of the second conductor clamping section with the compressibility comparison data.

2. The method of claim 1, further comprising:

a step of applying a connection state determining belt-shaped mark to each of the first conductor clamping section and the second conductor clamping section before clamping;

wherein, in the first determining step, the one of the dimensional variation and the ratio of the dimensional change of the first conductor clamping section is determined based on a change in width of the mark caused by clamping the first conductor clamping section, and wherein, in the second determining step, the one of the dimensional variation and the ratio of the dimensional change of the second conductor clamping section is compared with the compressibility comparison data.

3. The method of claim 1, further comprising:

a step of applying a pair of connection state determining belt-shaped marks to each of the first conductor clamping section and the second conductor clamping section before clamping, such that the belt-shaped marks are confronted with each other;

wherein, in the first determining step, the one of the dimensional variation and the ratio of the dimensional change of the first conductor clamping section is determined based on a change in distance between the marks caused by clamping the first conductor clamping section, and wherein in the second determining step, the one of the dimensional variation and the ratio of the dimensional change of the second conductor clamping section is compared with the compressibility comparison data.

4. The method of claim 3, wherein the marks are respectively applied along formation reference positions of wire breakage preventing bellmouths which are formed on both end portions of each of the first conductor clamping section and the second conductor clamping section by clamping each of the first conductor clamping section and the second conductor clamping section, and wherein the method further comprises a third determining step of determining whether formation of the bellmouths is acceptable or not by comparing the respective marks with respective positions of the bellmouths.

5. The method of claim 2, wherein, before the second determining step, the one of the dimensional variation and the ratio of the dimensional change of the second conductor clamping section is calculated based on a change in width of the mark caused by clamping the second conductor clamping section.

6. The method of claim 3, wherein, before the second determining step, the one of the dimensional variation and the ratio of the dimensional change of the second conductor clamping section is calculated based on a change in distance between the marks caused by clamping the second conductor clamping section.

* * * * *